United States Patent [19]

Warner

[11] 4,295,760

[45] Oct. 20, 1981

[54] ROCK BOLT ANCHOR

[76] Inventor: Clifford C. Warner, 7381 Bryant St., Westminster, Colo. 80030

[21] Appl. No.: 86,994

[22] Filed: Oct. 22, 1979

Related U.S. Application Data

[63] Continuation-in-part of Ser. No. 898,632, Apr. 21, 1978, abandoned.

[51] Int. Cl.[3] ..... E21D 21/00; F16B 13/04

[52] U.S. Cl. ..... 405/259; 411/33; 411/75

[58] Field of Search ..... 85/3 R, 3 K, 35, 63, 85/67, 69, 79, 74; 403/259

[56] References Cited

U.S. PATENT DOCUMENTS

| | | | |
|---|---|---|---|
| 211,253 | 1/1879 | Norris | 85/69 |
| 1,212,298 | 1/1917 | Weston | 85/64 |
| 1,407,570 | 2/1922 | Peirce | 85/64 |
| 2,842,999 | 7/1958 | Huston | 85/64 |
| 2,918,840 | 12/1959 | Roesler | 85/79 X |
| 3,192,822 | 7/1965 | Genter | 85/79 |
| 3,727,901 | 4/1973 | Textrom | 85/79 X |
| 4,011,787 | 3/1977 | White et al. | 405/259 X |
| 4,037,384 | 7/1977 | Molyneux | 405/260 X |
| 4,147,458 | 4/1979 | Elders | 405/259 |

FOREIGN PATENT DOCUMENTS

| | | | |
|---|---|---|---|
| 916286 | 8/1954 | Fed. Rep. of Germany | 405/259 |
| 788854 | 1/1958 | United Kingdom | 405/259 |

*Primary Examiner*—Thomas J. Holko
*Attorney, Agent, or Firm*—Horace B. Van Valkenburgh; Richard D. Law

[57] ABSTRACT

A series of adjoining cam discs are mounted on a foot having an inclined surface, with the cams surrounding a stem connecting the foot and a head of a diameter to fit within a borehole in rock. The stem extends axially between the head and the foot, while the inclined surface is spaced from the head and is inclined with respect to the axis of the anchor. The head has threads for receiving corresponding threads on a bolt which extends through the foot and stem, while the flat cam discs have a width less than, and a length greater than, the diameter of the borehole. The anchor is moved into the borehole and the cam discs are caused to engage the wall of the borehole, the bolt then being turned to thread the head against the cam discs and force the ends of the cam discs against or into the wall. In one form, the stem has flat sides and apertures in the cam discs have corresponding flat sides, to prevent rotation between the cam discs and the stem, while a non-rotation disc may be mounted on the stem between the cam discs and the inclined surface. This non-rotation disc also has flat inner sides to engage the stem, to stop rotation of the cam discs and stem when the anchor begins to turn with the bolt, after the anchor has been pulled downwardly into the borehole to set the cam discs. In another form, the bolt is rotated to rotate the cams at a sufficient speed to cause then, through centrifugal force, to move toward a position perpendicular to the anchor and thereby engage the bore wall. The inclined surface of the foot engages the cam disc remote from the head to retard movement thereof and also pull it toward the cam discs. Upon further rotation of the bolt, the head is pulled against the cam discs to force the ends thereof against or into the wall. A spiral lock washer may be placed between the head and the cam discs. Other features are also disclosed.

19 Claims, 21 Drawing Figures

ROCK BOLT ANCHOR

This application is a continuation-in-part of my copending application Ser. No. 898,632 filed Apr. 21, 1978, now abandoned.

This invention relates to rock bolt anchors, and more particularly to rock bolt anchors for use as mine roof anchors.

BACKGROUND OF THE INVENTION

At one time, mine and tunnel openings were protected and supported largely by the aid of wooden timbers extending both in an upright position and also across the roof of the tunnel. Such wooden timbers consumed an undue amount of space, particularly when upright, while the strength thereof was difficult to measure and seldom accurately predictable. Also, such timbers were frequently subject to deterioration, such as due to the effects of seepage water. A limited useage has been made of steel rods to support the roof and ribs of mine openings, by what has been referred to as "pinning". This consisted of pushing a rich mortar of sand and cement into a borehole, so that when a steel rod or pin was driven in, the mortar would set to form a bond between the rod and the hole. Later, an epoxy resin has been substituted for the sand and cement mortar. However, such cementing has not been able to produce the results desired.

It is reported that, initially, mine roof bolt anchorage was by means of a bolt threaded at one end and slotted at the other; then thrust into a borehole until a wedge inserted in the slot engaged the inner end of the borehole and the rod then driven against the wedge to split the sides of the slotted ends apart and grip the sides of the borehole. However, this was an awkward and tedious operation, due to the likelihood of damage to the bolt threads when driving the bolt inward and to the necessity for drilling the borehole to the exact depth necessary for the length of the bolt.

By midway of the present century, a number of torque set, retractable type anchors had been devised, which were usable with headed bolts and were set by retraction, rather than by being driven into the borehole. Although varied in appearance and form, all of such anchors have in common the mode of expansion by which a threaded conical, tapered or triangular plug is drawn through an outer leaf-like shell to stress a contact area of the shell-borehole interface. The extent of the resultant expansion, as intended to transfer bolt load to the sides of the borehole, is necessarily limited due to the inherent rigidity of any wedge or like triangular plug. Consequently, the loads which the previous anchors will sustain in some rock structures are limited and there is still the possibility of anchorage slippage failures. Rock bolts under tension may be used with anchors in a borehole drilled into the roof of a tunnel, for instance, for a distance sufficient to pass beyond a fractured area or a sufficient distance to provide a beam effect, i.e. clamp together a sufficient height of rock strata to produce a beam which bridges across the roof. Rock bolt anchors also may be located to take advantage of natural forces inherent in "the arch", which scientifically is defined as a means of spanning an opening by resolving downward pressures into horizontal to diagonal thrust.

More recently, resin grouted bolts have been developed, in which two plastic bags of epoxy resin components are pushed abead of a bolt, conventionally a normal or sheared reinforcing bar having serrations, into a borehole drilled to a predetermined depth until the bags reach the inner end of the borehole. Then, as the bar is thrust toward the end of the borehole, the bags containing the resin components are ruptured and the bar rotated to cause the resin components to be mixed. Rotation of the bar, after a selected time period, is stopped, then full machine thrust into the bore is applied, as at 5,000 lbs., and held until the resin reaches the gel stage, as at an elapsed time of 30 seconds. After final setting of the resin mixture, the desired load on the bolt is applied at the rock face. Informational Report No. 1033 of the Mining Enforcement and Safety Administration of the U.S. Department of the Interior (1976) and entitled "Comparative Evaluation of Conventional and Resin Bolting Systems" indicates that fast setting resins which attain 90% strength in 2–5 minutes are desirable. The principal relevance of resin grouted bolts is that they are rotated.

Among the objects of this invention are to provide a bolt anchor which can be anchored solidly and can substantially eliminate slippage, as by multiple-point expansive pressure over an extended circumferential area of the borehole; to provide such an anchor adjustable for selection of a predetermined area of borehole engagement; to provide such a bolt anchor which will normally produce a holding strength approaching the tensile strength of the bolt utilized; to provide such a bolt anchor which will anchor effectively in both hard rock and softer rock; to provide such an anchor with a structured safety stop, against anchor creep or slippage of increasing cam pressure, like a chock used in blocking a wheel; to provide such an anchor which may be placed at substantially any desired position in a borehole; to provide such an anchor which has a plurality of separate contact areas; to provide such an anchor which is adapted for use in different rock structures; to provide such an anchor which may be made in more than one form; to provide such forms which enable ecenomies to be secured, depending on the relative costs of casting and other types of forming; and to provide such an anchor which is efficient and effective in use.

BRIEF SUMMARY OF THE INVENTION

The bolt anchor of the present invention includes a series of centrally apertured cam discs which are generally elliptical in shape, with the curve of two ends, further apart, corresponding to the inside of the borehole, and the two sides, closer together, connecting the two ends. The length of each cam disc is greater than the diameter of the borehole, so that the cam discs may be moved upwardly into the borehole in an inclined position, avoiding engagement of both ends of the cam discs with the wall of the borehole prior to the desired time, but may then be forced outwardly against the borehole to engage the wall of the borehole at opposite but longitudinally separated positions. The anchor also includes a stem surrounded by the cam discs with an enlarged head at one end of the stem and a foot at the opposite end. The foot is preferably offset laterally from the stem, at least at one position, in a first embodiment. The central apertures of the cam discs permit movement along the stem. A threaded hole within the head accommodates the anchor bolt and permits the anchor to be drawn downwardly by the bolt. When the head of the anchor is moved downwardly against the cam discs by tightening the anchor bolt, the cam discs will be forced tighter into and against the rock, at each side, a smaller distance when the rock is relatively hard but a greater distance when the rock is softer. Thus, if the rock is sufficiently soft, the cam discs may be forced to a position transverse to the hole and extend into the rock, at each side of the hole, a relatively considerable distance. During such tightening of the cam discs against the opposite sides of the borehole, one disc can move slightly with respect to the adjacent discs, under sufficient pressure, to push into an area of the rock having a different resistance.

The cam discs are supported in the inclined position on the stem, as by an inclined or bevel surface on the foot. In one embodiment, means, such as a removable clip, lateral ears or projections on the foot or the like, prevents the cam discs, which have a central aperture for sliding on the stem, from falling off the anchor. Since the cam discs must be stationary in the borehole during anchoring, to permit the head to be pulled back against the cam discs, in this embodiment, interengaging means for preventing relative rotation between the cam discs and the stem is provided. Such interengaging means may comprise flat surfaces of the stem and flat sides of the inner apertures of the cam discs. In addition, a rotation restraining means is provided, to prevent the anchor from rotating with the anchor bolt when the latter is turned to move the cam discs against and/or into the wall of the borehole. For this purpose, an anti-rotation or non-spinning disc may be utilized, which is conveniently placed beneath the lowermost cam disc and may have an inside aperture corresponding to that of the cam discs, but sides and ends disposed inwardly from the maximum extension of the sides and ends of the cam discs. Of greater importance are corners, such as two or four, which extend beyond the cam discs and are adapted to scrape against the inside wall of the borehole, as the anchor is moved into position. The anti-rotation disc may be quite thin and formed of spring steel, while the corners may be rounded. However, when the anchor has reached its desired destination and the bolt has begun to be turned, engagement of the corners with the wall of the borehole should prevent any rotation of the cam discs and anchor relative to the inside of the borehole.

In a second form, the foot may be circular but provided with a similar inclined face to support the cam discs as the bolt and anchor are moved into the borehole, while the stem may be tubular and connected at one end to a head as by fine threads, and at the opposite end to the foot, as by a shrink or expansion fit. The cam discs may be cut from tubing of an appropriate wall thickness but by cuts, as at 45°, corresponding to the angle of the face of the foot, thereby providing inner and outer cylindrical surfaces of the assembled cam discs which encircle the tubular stem. Also, such cam discs have an upper biting edge at one end and a lower biting edge at the opposite end. This form is installed by threading the anchor onto the inner end of the bolt and inserting the head or nut at the outer end of the bolt into the chuck by which the drill which produced the borehole was rotated. The bolt and anchor are moved into the borehole without rotation and with the anchor in any position when the borehole is vertical but with end edges of the cam discs at the smaller side of the foot on the underside of the anchor, when the hole is horizontal or other than vertical. When the desired position of the anchor is approached, the bolt head is moved up to the bearing plate at the rock face and the bolt is rotated by the drill chuck at a suitable rate to cause the cam discs to rotate with the remainder of the anchor, since the cam discs rest on the face of the foot, until centrifugal force causes the cam discs to pivot and move toward a horizontal position. Before such movement toward a perpendicular position has progressed more than a relatively short distance, the upper and lower biting edges will have engaged the wall of the borehole, thereby stopping rotation of the cam discs. As the foot continues to turn, the edge of the inclined face will rotate into engagement with the underside of the then stationary cam discs and its rotation will also be stopped; thus, rotation of the head will be stopped but continued rotation of the bolt will cause the bolt to thread into the head and the head will be drawn into engagement with the cam discs and force them outwardly into the rock wall until the desired tension of the bolt is obtained. Preferably, a lock washer is inserted between the head and the cam discs, to be compressed between the head and cam discs as the head moves toward them, to relieve the stress on the bolt threads when the pressure of the cam discs first comes on them. The lower edge of the head may have a spiral surface providing a notch adapted to engage one end of the lock washer and rotate it until the other end of the lock washer digs into the cam discs.

The head, stem and foot of the first embodiment may be formed integrally, such as by casting, with a hole for the anchor bolt formed in the stem and foot, with threads therefor primarily in the head. For the second form, the head, stem and foot may be produced separately and attached together, as indicated previously. The head may be cast, forged or cut from bar stock, then machined, while the foot may be formed from heavy tubing, cut across at 90° to form one end of the foot and at 45° to form the face. In the usage of rock bolt anchors, as in usage of threaded connections in many other devices where bolt and nut threading may be subject to abusive treatment, bolting accessories can prove helpful. A feature that may be added to this rock bolt anchor is the placement between the cam assembly on the anchor stem and the anchor nut head of a standard helical spring lock washer. Also, the spring lock washer may be used in combination with a positive spiral clutch cast or structured at the base of the anchor head to assist in stopping any relative rotation between the anchor and the rock borehole.

The method of this invention was developed to provide maximum suitability for use with modern power driven roof drilling and anchor bolt positioning and tensioning devices, whereby the chuck used to drive the drill bit into the rock is also used, in follow-up of the drilling operation, to position the anchor in the borehole and then to spin the threaded bolt at a speed to expand the anchor laterally and then tighten it. It is to be noted that all of the "plug-and-shell" type anchors in general usage during the past were made using designs more than a quarter century old, to be seated and tensioned by slower, manually operative methods, to effect downward pull on the threaded anchor plugs. All of these previously available anchors had in common expansion by means of drawing a tapered or triangular plug through an outer leaf-like shell. As attested by the ANSI/ASTM Standard Specification for Roof and Rock Bolts and Accessories F432-76a, expansion shells are of two types—either the self-supporting by means, such as a bail, or a second type requiring support to remain in position during installation until anchored.

Also, Mining Enforcement and Safety Administration, U.S. Department of the Interior, Informational Report No. 1033 issued in 1976, similarly classified and described the available anchoring shells.

As the anchor, as of $1\frac{1}{4}$ in. diameter, is inserted perpendicularly into the drilled rock hole, the only forces noticeably resistant to upward movement of the anchor in a $1\frac{3}{8}$ in. diameter borehole, for instance, are gravitational or frictional due to possible intermittent contacts at the anchor-borehole interface. In case the anchor might be inserted into a borehole inclined at an angle or horizontal, the elliptical cams, stacked at 45° on the forward face of the anchor foot with the apertures of the cams exactly parallel to the periphery of the anchor stem, will remain in stasis due to the arrangement and the lever arm force of the cams. After the anchor has been moved to the point in the rock borehole where anchorage is to be effected, sequential forces are actuated and developed by power spinning of the rock bolt threaded into the anchor head. The angular foot fixed on the anchor stem, and spinning with it, then exerts a vector force in the direction which a right handed screw would advance if it were to be rotated. In sequence, the elliptical cams are skewed by the resultant force into orbital contact with the wall of the rock borehole. The braking force by the rock wall arrests and negates centrifugal force and rotation of the cams relative to the anchor stem. A more determinate force is directed downward by threaded retraction of the anchor head toward the lever arm forces of the cams acting in transverse direction. As the purpose of mechanical rock bolt anchorage devices, as generally stated, is that of transfer of bolt load to the sides of drilled rock holes, so the method herein described is competent for fulfilling its intended purpose.

THE DRAWINGS

The foregoing and additional features of this invention, as well as additional objects, will become apparent from the following description, taken in conjunction with the accompanying drawings, in which.

DESCRIPTION OF PREFERRED EMBODIMENTS

Figure 1:
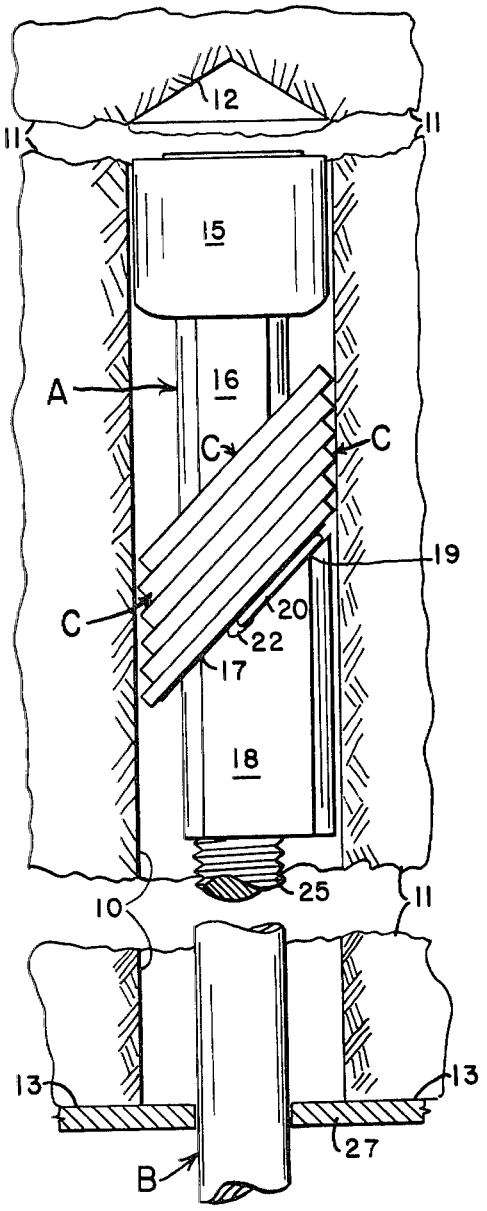
FIG. 1 is a condensed longitudinal section showing a rock bolt anchor of this invention being installed within a borehole.
Figure 2:
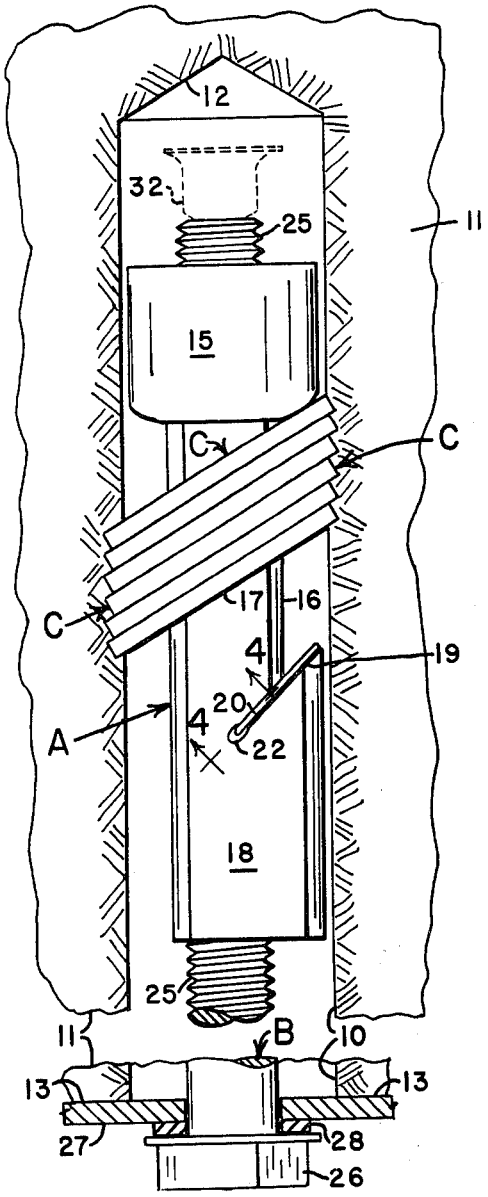
FIG. 2 is a similar condensed longitudinal section, but showing the anchor tightened in position, after being pulled downwardly to lock a series of cam discs against the wall of the borehole, as in relatively hard rock.
Figure 3:
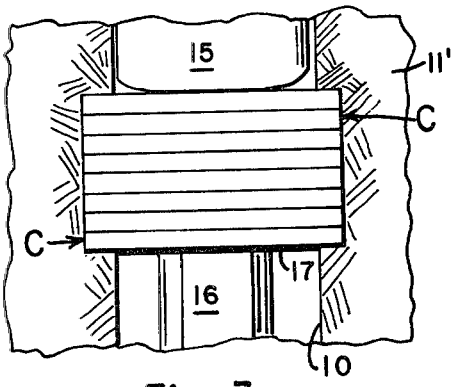
FIG. 3 is a fragmentary longitudinal section corresponding to a portion of FIG. 2, and showing particularly one possible position of the cam discs in a borehole in relatively soft rock.

One preferred embodiment of a bolt anchor A of this invention, as in FIGS. 1 and 2, is utilized with an anchor bolt B for insertion into a borehole 10 in rock 11, the borehole having an inner end 12 and extending from a rock face 13. Bolt B may be jointed if the height of the tunnel is less than the distance to which the anchor is to be inserted in the borehole. The anchor A in one embodiment formed in a suitable manner, as by casting, includes a body having a head 15 connected to a stem 16, surrounded by a series of cam discs C which are moved into the borehole, as in FIG. 1, in an inclined position. The cam discs C and stem 16 are provided with means for preventing rotation of one with respect to the other, such as cooperating flat surfaces described below, while a very thin, anti-rotation or non-spinning disc 17 also surrounds the stem and prevents rotation of the anchor relative to the borehole, particularly when the bolt B is turned to retract the anchor within the borehole, which causes the head 15 to be moved against the cam discs C and force them into engagement with the wall of the borehole on opposite sides thereof, in order to provide a non-slipping installation. For hard rock, such as granite, the cam discs may penetrate the wall of the bore to an extent determined by the hardness of the rock, but illustrated generally in FIG. 2, in which the head 15 of the anchor abuts against the uppermost cam disc. However, in softer rock 11' of FIG. 3, such as limestone, the cam discs C may penetrate further into the rock at each side of the bore, such as until a transverse position, as illustrated, is produced. The length of the cam discs is, of course, greater than the diameter of the bore, so that penetration to the position of FIG. 3 is possible with sufficiently soft rock, although the normal position in harder rock will correspond generally to that shown in FIG. 2.

Figure 4:
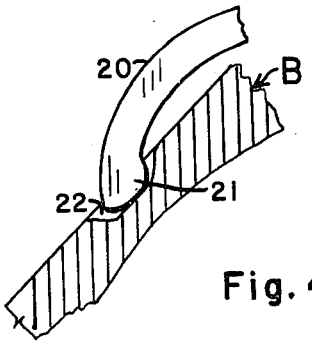
FIG. 4 is an enlarged fragmentary section taken along line 4—4 of FIG. 2.
Figure 13:
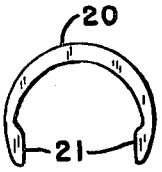
FIG. 13 is a plan view of a retaining clip forming part of the anchor of FIG. 1.

The body of anchor A is also provided with a foot 18 which is offset at one side and provided at that side with a bevel or inclined surface 19, against which rests a semicircular clip 20, shown also in FIG. 13, being retained by an ear 21, as in FIG. 4, at each side within a notch 22 formed at the lower edge of bevel 19. The clip 20 is preferably a spring clip and may be removed or replaced when a series of cam discs are to be installed on or removed from the body of anchor A, respectively. In the inclined position, the cam discs have an upper end and a lower end, assuming that the anchor is being thrust upwardly into a borehole inclined upwardly from the horizontal, although the anchor may be thrust into a horizontal or even a downwardly inclined borehole, in the latter instance with the one ends of the cam discs closer to the head of the anchor than the other ends of the cam discs. During this movement, the lower or remote ends of the cam discs move along the wall of the borehole but will not impede the movement of the anchor, since these ends are the trailing ends and are inclined at an angle to the borehole but away from the head of the anchor. The bolt B is provided with threads 25 at its inner end and an integral nut 26 at its outer end, for engagement with a bearing plate 27, such as six to eight inches on a side and having a square, triangular or rectangular configuration. Bearing plate 27 is pressed against the rock face 13 by nut 26 of bolt B, when tightened, as through a washer 28. The bearing plate 27 may also be provided with a conventional circular depending bell, which stiffens the plate and against the lower end of which the nut 26 bears, as through a washer, when desired.

Figure 7:
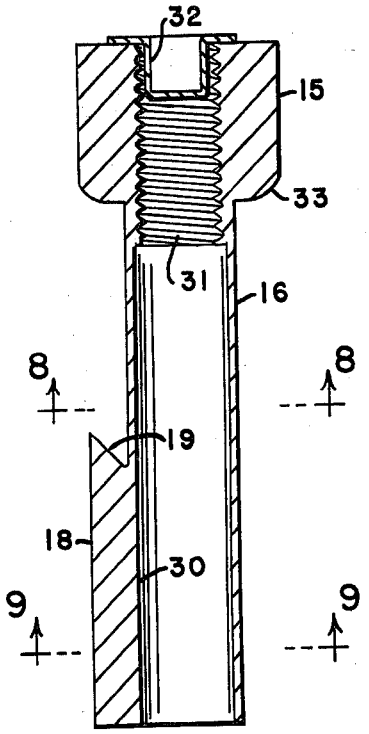
FIG. 7 is a longitudinal section taken along line 7—7 of FIG. 6.

As in FIG. 7, the body of anchor A is provided with a longitudinal hole 30 which extends centrally within the stem 16 and head 15, with threads 31 conveniently being provided within head 15 for engagement by threads 25 of the bolt B and retraction of the anchor head against cam discs C, while the lower corner 33 of the head 15 is rounded, as shown, to improve bearing against the uppermost cam disc C. The larger size of head 15 provides a greater resistance to stress, than if the bolt engaged threads on the inside of foot 18, for instance. Thus, the stem 16 may have thinner walls because it is not subject to load, either during or after tightening of the bolt. The thread protector 32, of any suitable material, such as plastic, may be placed within the hole at the end of head 15 to protect the threads 31 from dirt and the like. As in FIG. 2, if the threads 25 of the bolt B extend through the head, the bolt will merely push the thread protector 32 out of the head.

Figure 5:
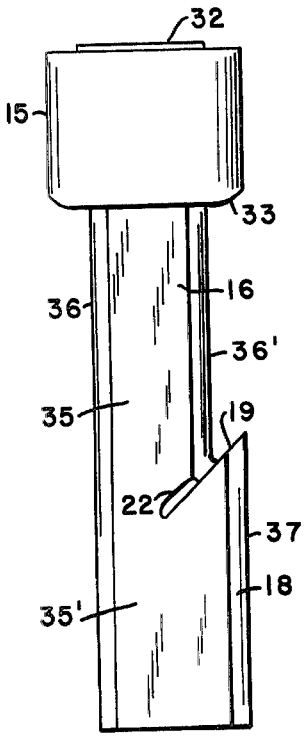
FIG. 5 is a side elevation of a body of the anchor of FIG. 1.
Figure 6:
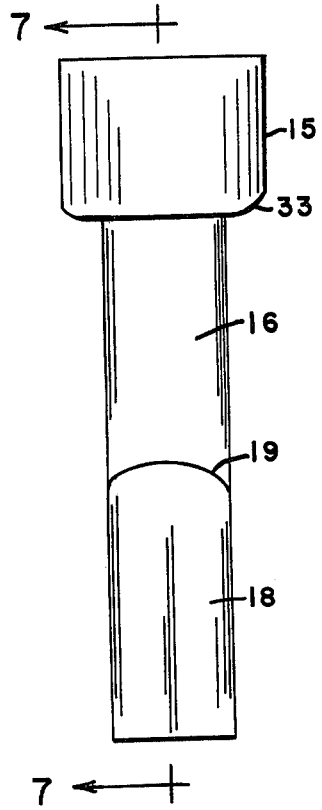
FIG. 6 is an end elevation of the body of the anchor.
Figure 8:
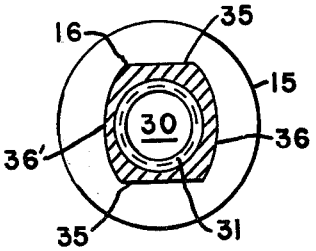
FIG. 8 is a cross section taken along line 8—8 of FIG. 7.
Figure 9:
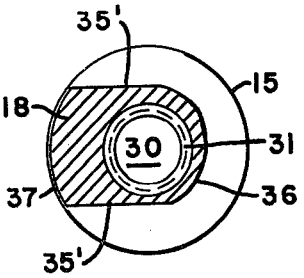
FIG. 9 is a cross section taken along line 9—9 of FIG. 7.
Figure 11:
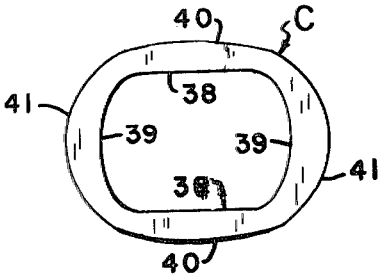
FIG. 11 is a plan view of a cam disc of the anchor of FIG. 1.

Stem 16, as in FIGS. 5 and 8, is provided with flat sides 35 and arcuate edges 36 and 36', the former of which extend downwardly along the foot 18, as in FIG. 9, while a continuation 35' of each flat side of the stem 16 extends downwardly along the foot 18. The flat sides 35' extend across the offset of foot 18 to an arcuate edge 37 having a radius generally corresponding to that of head 15. The aperture of each cam disc C, as in FIG. 11, may be provided with flat inner sides 38 and arcuate inner ends 39, with flat inner sides 38 spaced apart a distance corresponding to the distance between flat sides 35 of stem 16 and flat sides 35' of foot 18, with a small clearance. Thus, flat inner sides 38 of the cam discs C cooperate with the flat sides 35 of stem 16 to prevent relative rotation between the cam discs and stem. Also, the inner sides 38 of the cam discs clear sides 35' of foot 18 to permit the cam discs to be moved along the foot 18 and onto or off the stem, in the absence of clip 20. The distance between inner ends 39 of the cam discs is greater than the distance between edges 36 and 37 of foot 18, to clear these edges when the cam discs are moved onto or off the body of the anchor, even in an inclined position.

The exterior of each cam disc C is generally elliptical, having longer radius sides 40 which are spaced closer together than the shorter radius ends 41, which may correspond generally in curvature to the inside of the borehole 10 of FIGS. 1 and 2. As will be evident, when the cam discs C are moving into the borehole, normally upwardly as in FIG. 1, the inclined position of the cam discs will be such that the cam discs will tend to slide toward the lower edges thereof, remote from the head 15. Thus, the length of each cam disc is such that, in the inclined position of FIG. 1, the opposite ends 41, i.e. the upper ends shown in FIG. 1, will not contact the wall of the bore and the anchor bolt may be moved readily into the borehole. However, during movement as in FIG. 1, the cam discs would engage the inclined surface 19, since the distance between an inner edge 39 and an outer edge 41 of a cam disc is greater than the distance between the offset edge 37 of foot 18 and the inner wall of the borehole. Thus, the principal purpose of clip 20 is to retain the cam discs on the stem during storage, shipping and handling prior to insertion in the borehole.

Figure 10:
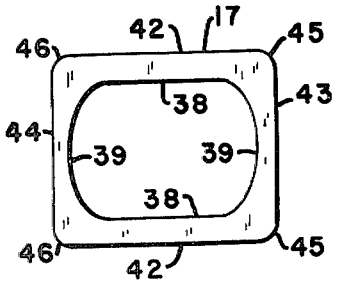
FIG. 10 is a plan view of a thin, spin arresting or anti-rotation disc of the anchor of FIG. 1.

The cam discs C may be cast, as of ductile iron, or forged or stamped, and may be on the order of $\frac{1}{8}$ inch in thickness. However, the anti-rotation disc 17 may be on the order of 0.015 inch in thickness and is preferably formed of spring steel, bronze or the like, so that it will resist distortion while moving into the borehole, although it will normally become deformed when the anchor bolt is tightened. As in FIG. 10, the disc 17 is provided with inner sides 38 and inner ends 39 of an inside aperture substantially identical to that of the cam discs C, but with the parallel outer sides 42 and parallel outer ends 43 and 44 which are spaced inwardly from the maximum lateral and lengthwise extent, respectively, of the cam discs C. The end 44 of the disc 17 may be spaced slightly closer to the adjacent inner end 39 than is the opposite outer end 43, for a purpose described later. The corners 45 at the intersections of sides 42 and end 43, as well as the corners 46 at the intersection of sides 42 and end 44, are slightly rounded, as shown, but each extends radially beyond the adjacent cam disc C, so that the corners 45 and 46 will tend to scrape along the wall as the bolt anchor moves into the borehole. However, due to the minimum thickness and the resilient nature of the disc 17, such contact does not interfere with the movement of the anchor into the borehole. When the movement of the anchor is stopped and the bolt B starts to turn in order to retract the head 15 against the cam discs C, the corners 45 and 46 will engage the wall of the bore sufficiently to prevent the anchor from turning with the bolt. Thus, the corners 45 and 46 have an important purpose in preventing such accidental turning, so that the head 15 may be retracted against the cam disc C until a position, such as shown in FIG. 2 or in FIG. 3, is reached, wherein the cam discs are tight against the wall of the borehole and a suitable stress may be placed on the bolt B to clamp the plate 27 against the rock face 13. As will be evident, if there are any discontinuities in the rock between the rock face 13 and the position of the anchor bolt A, the anchor may often be embedded in solid rock above them and thus hold the fractured rock up against any tendency for it to fall due to the discontinuities. If the discontinuities in the rock, such as cracks, extend above the borehole, a solid seating of the anchor will permit the fractured rock portions to be clamped together by the anchor bolt to form a beam, which extends across from one side of the tunnel to the other. It is normal, of course, to use more than one anchor laterally in the roof of a tunnel, for instance, as well as a series of anchors spaced longitudinally along the tunnel, normally at the center thereof, or a combination of lateral and longitudinal anchors, depending upon the characteristics of the rock above. The anchor bolts may also be utilized in the roofs of stopes, chambers or the like, as well as in the side walls of tunnels or chambers, in the event reinforcement of the rock at such positions appears to be appropriate.

Figure 12:
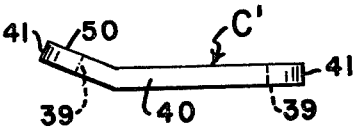
FIG. 12 is a side view of a cam disc, similar to the disc of FIG. 11 but modified for use in boreholes having a relatively slippery surface.

For extremely hard rock, such as quartz, the cam discs C′ of FIG. 12 may be utilized. These cam discs are provided with a bend 50 which produces an angularity at one end, but are otherwise similar to the cam discs C. Bend 50 of the cam discs C′ are preferably placed at the lower side of the inclination, as the anchor bolt is moved upwardly into the borehole, since the end of the bend will have a greater tendency to bite into the rock when movement of the anchor bolt is stopped and retraction is begun.

ANSI-ASTM F432-76A Standard Specifications for mine roof rock bolts and accessories, for $\frac{5}{8}$ inch mine roof bolts, include a high strength bolt having a minimum yield point of 12,400 pounds and an ultimate tensile strength of 19,200 pounds and an extra high strength bolt having a minimum yield point of 17,000 pounds and an ultimate tensile strength of 22,600 pounds. A MESA, e.g. Mine Equipment Safety Administration, standard is that a roof bolt connected to an anchor being tested should not be displaced more than 0.030 inch per kip, i.e. 1000 pounds, of load or exceed 0.500 inch at the yield point of the bolt, with the test discontinued if the bolt displacement exceeds 0.500 inch. Results of four tests of roof bolt anchors of the foregoing embodiment of this invention connected to $\frac{5}{8}$ inch roof bolts were as follows, with the load in kips in the first column and the displacement in inches in the remaining columns:

| Test | A | B | C | D |
|---|---|---|---|---|
| No. Cams | 6 | 7 | 7 | 7 |
| Rock | Hard | Hard | Hard | Soft |
| Loads, Kips | Limestone | Limestone | Sandstone | Limestone |
| 4 | 0.015 | 0.005 | 0.010 | 0.010 |
| 6 | 0.040 | 0.015 | 0.040 | 0.030 |
| 8 | 0.060 | 0.030 | 0.055 | 0.050 |
| 10 | 0.075 | 0.040 | 0.095 | 0.100 |
| 12 | 0.090 | 0.055 | 0.140 | 0.200 |
| 14 | 0.115 | 0.090 | 0.185 | 0.275 |
| 16 | 0.175 | 0.167 | 0.350 | 0.410 |
| 17 | | 0.210 | | |
| 18 | 0.225 | 0.270 | 0.500 | 0.560 |
| 19 | | 0.290 | | |
| 20 | 0.300 | 0.380 | | |

It will be noted that for the six cam anchor of test A, a lesser displacement of 18 and 20 kips in the same rock was obtained, than for the seven cam anchor of test B. The softer rock of test C apparently contributed to the lower results of test C, although all three tests came within the MESA standard. The character of the rock in test D undoubtedly contributed to the lesser results of that test, although the anchor of test D outperformed a well recognized and accepted bail type anchor for the same size bolt in the same rock, e.g. soft or weak, coarse grained limestone. It is possible that the results of test D could be improved if a greater number of cams were utilized.

Figure 15:
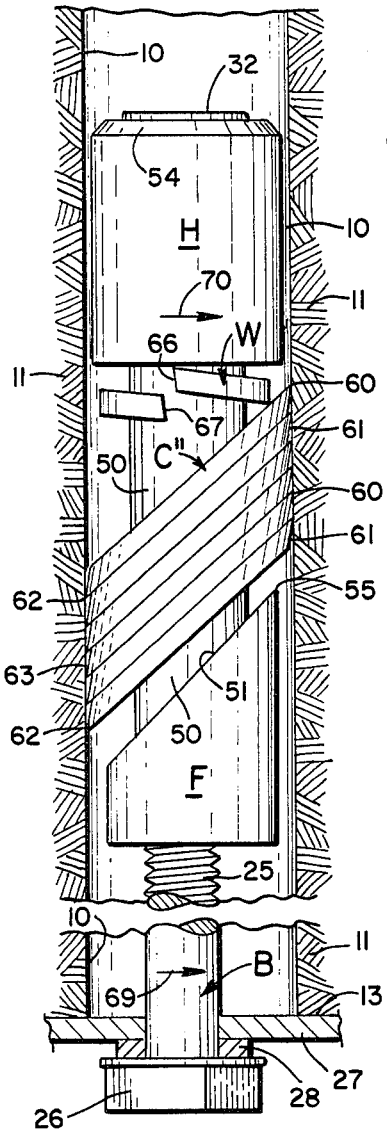
FIG. 15 is a condensed, longitudinal section similar to FIG. 2 but showing the anchor of FIG. 14 upon rotation to force a series of cam discs against the wall of a borehole by centrifugal force.
Figure 16:
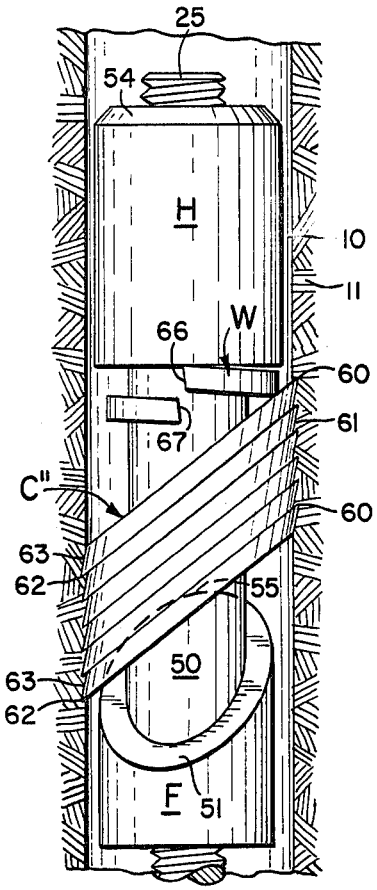
FIG. 16 is a fragmentary, longitudinal section similar to a portion of FIG. 15 but showing the anchor after the cam discs have started to penetrate the wall of the borehole upon threading the bolt into a head of the anchor following engagement of a foot of the anchor with the underside of the cam discs.
Figure 17:
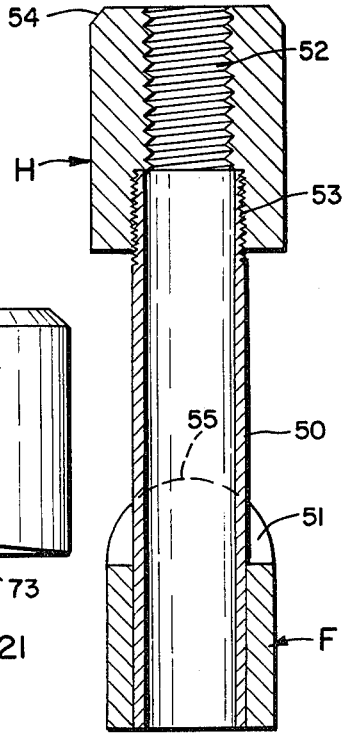
FIG. 17 is a longitudinal section of the anchor taken along line 17—17 of FIG. 14, but omitting a set of cam discs and a lock washer.

In the alternative embodiment illustrated in FIGS. 14–20, with which the method of this invention is carried out, the anchor bolt may be a composite construction including a head H to which is attached a stem 50 which is formed of tubing and is in turn attached to a foot F and having an inclined face 51, on which rest a series of cam discs C″ in an inclined position. As before, the anchor is mounted on threads 25 of a bolt B for insertion in a borehole 10 in rock 11, in a manner similar to that illustrated in FIG. 1. The head H, as in FIG. 17, is provided with interior threads 52 which are engaged by threads 25 of bolt B and fine threads 53 which are engaged by corresponding threads at the upper end of stem 50. The diameter of fine threads 53 is sufficiently greater than the diameter of threads 52 for the bolt that the inside of stem 50 will clear the bolt threads 25. The upper edge of the head may be provided with a bevel 54 to facilitate movement of the head into the borehole.

The inclined face 51 of foot F has an apex 55, which is shown more clearly in FIGS. 16 and 17, while stem 50 is received in a bore 56 of the foot, in which the stem may be attached by threads or by welding but preferably by a shrink or expansion fit. Although foot F may be expanded by heat and shrunk onto the stem, it is preferable to produce the stem 50 with an outer diameter a few thousandths of an inch greater than the diameter of bore 57. Preferably after fine threads 53 have been machined in the stem, the stem is immersed in either dry ice, e.g. solid carbon dioxide, or high purity liquid nitrogen, to shrink the stem to an outer diameter less than the bore 57. Then, the stem is placed in the bore 56, as in a jig, so that upon heating to normal temperature, expansion of the stem will produce an outward force against the inside of the bore that will withstand more than the longitudinal stress or torque on the foot.

Figure 14:
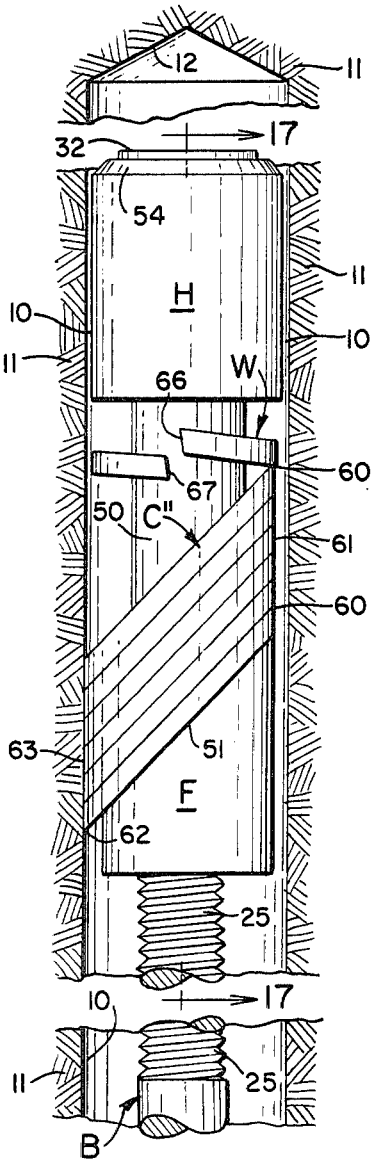
FIG. 14 is a condensed, fragmentary, longitudinal section similar to a portion of FIG. 1, but showing an alternative form of the rock bolt anchor.
Figure 18:
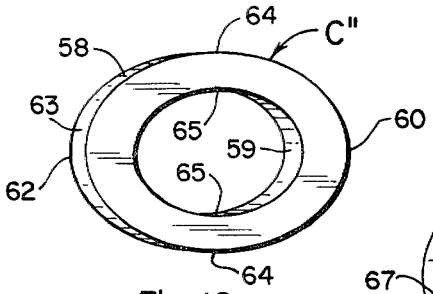
FIG. 18 is a top plan view of an elliptical cam disc of the anchor bolt of FIG. 14.
Figure 19:
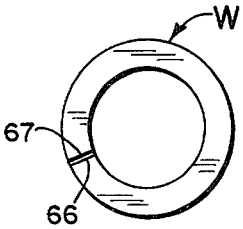
FIG. 19 is a top plan view of the lock washer of the anchor bolt of FIG. 14.

The cam discs C″, as in FIGS. 14, 15 and 18, may be formed by sawing at a 45° angle, at spaced positions, on a heavy tube of appropriate wall thickness and outer diameter, to provide a cylindrical outer surface 58, a cylindrical inner surface 59, a biting edge 60 at one end 61 and a biting edge 62 at the opposite end 63. As in the case of cam discs C, the general shape is elliptical, with the ends 61 and 63 spaced further apart than outer sides 64, while the inner sides 65 are spaced apart a distance greater than the outer diameter of tube 50 and the distance between biting edges 60 and 62 is greater than the diameter of the borehole. Thus, in the assembled position of FIG. 14 with the cam discs resting against face 51 of foot F, a cylindrical outer surface 58 and inner surface 59 of each cam disc will tend to be in alignment with corresponding surfaces of other cam discs, although during introduction into the borehole, as in FIG. 14, the cam discs will tend to move along face 51 and away from apex 55, i.e. toward the shorter side of the foot, so that an end 61 adjacent apex 55 will be spaced from the wall of borehole 10 and the opposite end 62 will more nearly approach or move along the opposite wall of the borehole with perhaps intermittent contact.

A lock washer W, having an inside diameter greater than the outer diameter of tube 50, may be interposed, encircling the tube 50, between head H and the nearest cam disc C″, i.e. the uppermost cam disc as shown in FIG. 14. Lock washer W, as in FIGS. 19 and 20, may be a conventional spiral lock washer having offset ends 66 and 67, each of which has a conventional bevel, as shown. During movement into an upwardly extending borehole, as in FIG. 14, the lock washer may rest on the upper biting edge 55 of the uppermost cam disc. During introduction into a horizontal borehole, both the cam discs and the lock washer will tend to assume the relative positions of FIG. 14, since the foot F will be pushing the cam discs into the borehole and the cam disc remote from the foot will push the washer into the bore. Thus, for installation of the preferred embodiment of FIGS. 14–20, and in accordance with the method of this invention, a conventional power driven chuck, normally used to rotate the drill by which the borehole 10 is drilled in the rock 11, is connected to the nut 26 or head of the bolt B and the bolt, with the anchor threaded thereon is moved into the borehole but without rotation. When the anchor has reached a desired position, as when washer 28 at the bolt head abuts the bearing plate 27 which engages the rock face 13, as in FIG. 15, the bolt B is rotated by the chuck so that the bolt rotates in the direction of arrow 69 and the anchor head H and foot F in the corresponding direction of the arrow 70. As the speed of rotation of the bolt increases, the cam discs C″ will rotate with the foot, since they are supported by face 51, but a speed will be reached, when the centrifugal force on the cam discs will cause them to pivot toward a horizontal position, i.e. toward a position perpendicular to the axis of rotation of bolt B. Thus, the cam discs will turn about an axis perpendicular to the axis of rotation until the biting edges 60 and 62 will engage the rock at the opposite ends of the cam discs, as shown in FIG. 15, which will stop rotation of the cam discs; when the cam discs stop rotating, the face 51 of the foot will move into engagement with the underside of the lowermost or adjacent cam disc and the foot will stop rotating. This will stop the head from rotation and also pull the head toward the cam discs, so that the bolt threads 25 will quickly begin to thread through the head, while the head, as in FIG. 16, will then begin to compress washer W against the uppermost cam disc, forcing the biting edges further into the rock and causing the bolt to tighten in the anchor until the desired bolt tension is produced, such as one half of the yield point of the bolt, to provide a factor of safety for prevention of roof sag. The amount of movement of the bolt threads 25 through the head H may be slightly exaggerated for the position of face 51 of foot F, which is shown as still in engagement with the underside of the lowest cam disc C″, since as the bolt B threads through head H, the foot F will separate from the cam discs C when they are in fixed position. Thus, the position of threads 25 in FIG. 16 may be considered as primarily for illustrative purposes.

Figure 21:
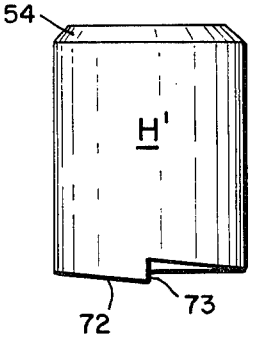
FIG. 21 is a side elevation of a modification of the head of the anchor bolt of FIG. 14.
Figure 20:
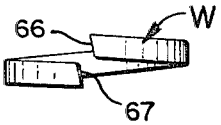
FIG. 20 is a side elevation of the lock washer of FIG. 19.

Head H′ of FIG. 21 is a modification of the head H of FIG. 14 and has a spiral lower surface 72 which surrounds the bore in which fine threads 53 of FIG. 17 are tapped and which may be formed by casting or machining. Surface 72 provides a notch 73 which, as the head rotates in the direction of arrow 70 of FIG. 15, is adapted to engage end 66 of washer W when the rotation of cam discs C″ is stopped, as described previously, to insure that the opposite edge 67 of the washer will engage the upper side of the uppermost disc C″ as viewed in FIG. 15. Edge 67 of the washer will tend to dig into the uppermost disc and insure that the maximum height of the washer will move around to a position between head H and the uppermost disc adjacent the apex 55, in the event that engagement of face 51 of foot F does not arrest rotational movement of head H. The installation is completed in a manner similar to that described above in connection with FIGS. 14–16.

Although preferred embodiments of the invention and certain variations have been illustrated and described, it will be understood that other embodiments may exist and that various other changes may be made, without departing from the spirit and scope of this invention.

What is claimed is:

1. A rock bolt anchor, comprising:

a head of a diameter to fit within a borehole in rock;

a stem connected to said head and extending axially therefrom, said head extending laterally beyond said stem;

a foot connected to said stem opposite said head, said foot having a lateral dimension less than said head and an inclined surface spaced from said head but comprising a surface of said foot nearest said head, said surface being inclined with respect to the axis of said anchor;

a longitudinal hole in said head, said hole being provided with threads for engaging corresponding threads of a bolt by which said anchor may be moved into said borehole in said rock, said bolt extending through said foot and said stem;

a series of adjoining cam discs surrounding said stem and having a width less than the diameter of said borehole and a length greater than the diameter of said borehole, said cam discs having apertures therein permitting said discs to surround said stem and engaging said inclined surface of said foot in an angular position on said foot during movement of said anchor into said borehole, said stem having a length sufficient to accomodate said angular position of said cam discs;

said anchor being movable into said borehole by said bolt with said cam discs in said angular position to a predetermined point in said borehole;

said anchor being rotatable with said bolt at a sufficient speed to cause said ends of said discs to engage the wall of said borehole and terminate rotation of said discs; and said inclined surface of said foot being constructed so as to then be engageable with the disc remote from said head to terminate rotation of said head and permit said bolt to thread through said head and said head then retracted by rotation of said bolt, whereby said head engages said cam discs and forces the ends thereof outwardly into the rock of said borehole to restrain further downward movement of said anchor.

2. A rock bolt anchor as defined in claim 1, wherein said inclined surface of said foot extends for substantially the width of said foot.

3. A rock bolt anchor as defined in claim 1, including:

a lock washer having normally offset ends and surrounding said stem between said head and said cam discs.

4. A rock bolt anchor as defined in claim 3, wherein:

said end of said head adjacent said lock washer has a spiral form providing a notch for engaging one end of said lock washer.

5. A rock bolt anchor as defined in claim 1, wherein:

said cam discs are provided with planar, parallel surfaces adapted to abut said inclined surface of said foot and corresponding surfaces of other cam discs when in superimposed relation on said inclined surface;

said cam discs have inner and outer surfaces which form essentially an inner and outer cylinder with said cam discs in alignment and engaging said inclined surface of said foot; and said outer surfaces are disposed at an acute angle to an adjacent planar surface at each end of said discs to provide biting edges for engagement with the wall of said borehole.

6. A rock bolt anshor, comprising:

a head of a diameter to fit within a borehole in a rock;

a stem connected to said head and extending axially therefrom, said head extending laterally beyond said stem;

a foot connected to said stem opposite said head, said foot having a lateral dimension less than said head and an inclined surface spaced from said head but comprising a surface of said foot nearest said head, said surface being inclined with respect to the axis of said anchor;

a longitudinal hole in said head, said hole being provided with threads for engaging corresponding threads of a bolt by which said anchor may be moved into said borehole in said rock, said bolt extending through said foot and said stem;

a series of adjoining cam discs surrounding said stem and having a width less than the diameter of said borehole and a length greater than the diameter of said borehole, said cam discs having apertures therein permitting said discs to surround said stem and engaging said inclined surface of said foot in an angular position on said foot during movement of said anchor into said borehole, said stem having a length sufficient to accommodate said angular position of said cam discs;

interengaging means of said cam discs and said stem for restraining relative rotation between said cam discs and said stem; and said anchor being movable into said borehole by said bolt with said cam discs in said angular position to a predetermined point in said borehole and said head then retracted by said bolt, whereby said head engages said cam discs and forces the ends thereof outwardly into the rock of said borehole to restrain further axial movement of said anchor.

7. A rock bolt anchor as defined in claim 6, wherein:

said interengaging means of said cam disc and said stem comprise non-circular surfaces.

8. A rock bolt anchor as defined in claim 7, wherein:

said surfaces of said cam discs are generally parallel; and said surfaces of said stem are generally parallel and extend longitudinally of said stem.

9. A rock bolt anchor as defined in claim 6, including:

a rotation restraining disc associated with said cam discs and having sides and ends with rounded corners between said sides and at least one end, the thickness of said rotation restraining disc being a fraction of the thickness of said cam discs; and the rounded corners of said rotation restraining disc extend outwardly beyond said cam discs for frictional engagement with the surface of said borehole to restrain rotational movement of said anchor in said borehole when said bolt is turned to retract said head against said cam discs.

10. A rock bolt anchor as defined in claim 9, wherein:

said sides and ends of said rotation restraining disc are essentially flat.

11. A rock bolt anchor as defined in claim 7, including:

a rotation restraining disc surrounding said stem and provided with non-circular surfaces engageable with non-circular surfaces of said stem.

12. A rock bolt anchor as defined in claim 6, wherein:

the peripheral contour of said foot corresponds to non-circular apertures in said cam discs; and means for retaining said cam discs on said inclined surface of said foot.

13. A rock bolt anchor as defined in claim 12, wherein:

said means for retaining said cam discs includes a removable clip associated with said foot.

14. A method of installing a rock bolt anchor in a borehole in rock, comprising:

mounting a series of adjoining cam discs on a foot having an inclined surface and surrounding a stem connecting said foot and a head of a diameter to fit within said borehole;

said stem extending axially from said head and said inclined surface being spaced from said head but comprising a surface of said foot having an apex nearest said head, said surface being inclined with respect to the axis of said anchor;

said head having a longitudinal hole provided with threads for engaging corresponding threads of a bolt by which said anchor is moved into said borehole in said rock, said bolt extending through said foot and said stem;

said cam discs having a width less than the diameter of said borehole and a length greater than the diameter of said borehole, said cam discs having apertures therein permitting said discs to surround said stem and engaging said inclined surface of said foot in an angular position on said foot during movement of said anchor into said borehole, said stem having a length sufficient to accommodate said angular position of said cam discs;

moving said anchor into said borehole by said bolt with said cam discs in said angular position to a predetermined point in said borehole; and rotating said bolt at a sufficient rate to cause said cam discs to begin movement toward a position perpendicular to the axis of said bolt and thereby cause the ends of said cam discs to engage the wall of said borehole and terminate rotation of said cam discs, whereby further rotation of said foot causes said apex of said inclined surface to engage the cam disc remote from said head and reduce rotation of said head, thereby permitting said bolt to thread into said head and draw said head into engagement with said cam discs to force the ends thereof outwardly into the rock of said borehole.

15. A method of installing a rock bolt anchor in a borehole as defined in claim 14, which includes:

installing a lock washer having normally offset ends in a position surrounding said stem between said head and said cam discs.

16. A method of installing a rock bolt anchor as defined in claim 14, wherein said borehole is produced by a rotating drill bit and means for normally rotating said drill bit, which includes:

providing said means for rotating said drill bit with a chuck for rotating said bolt; and rotating said bolt when said predetermined point in said borehole is reached by said means for normally rotating said drill bit.

17. A method of installing a rock bolt anchor in a borehole as defined in claim 14, which includes:

attaching said stem to said head by relatively fine threads.

18. A method of installing a rock bolt anchor in a borehole as defined in claim 14, which includes:

constructing said foot with a longitudinal hole having a diameter less than the diameter of said stem;

chilling said stem to reduce the diameter thereof to less than the diameter of said hole in said foot;

inserting said chilled stem in said hole in said foot; and permitting said stem to warm and thereby expand, so as to provide a force between said stem and said hole in said foot which attaches said stem to said foot in a manner which resists longitudinal and torsional stresses transmitted between said foot and said stem.

19. A method of installing a rock bolt anchor in a borehole as defined in claim 14, which includes:

increasing the length of said stem to accommodate a greater number of cam discs between said head and said foot for rock of a predetermined characteristic; and decreasing the length of said stem to accommodate a lesser number of cam discs on said stem between said head and said foot for rock of another predetermined characteristic, thereby providing predetermined control of the area of the borehole to be engaged by the cam discs.

* * * * *